United States Patent [19]

Henning

[11] Patent Number: 4,576,304

[45] Date of Patent: Mar. 18, 1986

[54] EASY-OPEN CLOSURE

[75] Inventor: John C. Henning, Fairfield, Ohio

[73] Assignee: Product Investment Incorporated, Cincinnati, Ohio

[21] Appl. No.: 734,041

[22] Filed: May 15, 1985

[51] Int. Cl.[4] ..... B65D 17/34

[52] U.S. Cl. ..... 220/269; 220/270

[58] Field of Search ..... 220/269–273

[56] References Cited

U.S. PATENT DOCUMENTS 1,856,543 5/1932 Ericsson ..... 220/270

2,085,200 6/1937 Ljungstrom ..... 220/270

*Primary Examiner*—George T. Hall

*Attorney, Agent, or Firm*—Wood, Herron & Evans

[57] ABSTRACT

A closure for beverage cans including a key-shaped sealing tab delineated by a line of weakening in the top panel and a lift tab overlying the sealing tab. The sealing tab includes two parallel downwardly sloping grooves having vertical end walls. A projection having a vertical wall is disposed between the grooves. A raised, fulcrum rib is disposed adjacent the end walls of the grooves. The lift tab includes a main portion and two downwardly extending side arms interconnected by a pivot arm. The side arms are disposed in the grooves. The pivot arm is restrained for pivotal movement by the vertical wall of the projection, the end walls of the grooves and the bottom wall of a second projection formed in the lid. When the lift tab is raised, it initially pivots about the axis of the pivot arm and then about the fulcrum rib. During this latter movement, the arm portion of the lift tab applies a force to the sealing tab causing it to be partially severed and to be moved outwardly away from the pouring opening.

21 Claims, 6 Drawing Figures

EASY-OPEN CLOSURE

BACKGROUND OF THE INVENTION

This invention relates to beverage cans and is particularly directed to a closure construction for such cans of the type which may be opened by lifting a tab member to partially sever a sealing tab from the can top.

It has previously been proposed to provide metal beverage cans formed of aluminum, light gage steel, or the like, having a top with a key or pear-shaped opening defined by a score line or line of weakening. A pull tab is connected to this panel portion in such a manner that when the pull tab is lifted, the sealing panel is partially severed along the score line and is forced downwardly into the interior of the can. Such prior art cans are advantageous in that they can be opened in a simple manner without the use of auxiliary implements.

Cans of the type described are further advantageous in that the panel portion which is torn to expose the pouring opening is not completely separated from the can, but remains attached to the main can body so that the problem of excessive littering by torn tear strips, lifting tabs or the like is eliminated.

Despite these advantages, however, cans of the type described are subject to one or more serious disadvantages. In the first place, such cans are inherently unsanitary since the unprotected top is forced downwardly into the contents of the can as a normal incident to can opening. This may result in contamination of the beverage or other contents of the can.

A second disadvantage of prior art cans is that the pull tab and panel are frequently joined by a rivet-like construction involving the formation of a hollow rivet on the panel which passes through an opening in the pull tab and is subsequently flattened to hold the two members in assembled relationship. This so-called rivet construction is a frequent cause of rejects due to leakage as a result of the formation of cracks in the rivets during assembly of the closures.

A still further objection of other can closures which have been proposed is that they are difficult to open, i.e., they require an inordinate amount of force to operate the pull tab or the like.

SUMMARY OF THE INVENTION

The principal object of the present invention is to provide a closure for beverage cans, which closure includes a sealing tab normally forming part of the can top, the sealing tab being delineated by a score line and a lifting tab, the lifting tab, when actuated, being effective to partially sever the sealing tab from the can top and to force it outwardly away from the pouring opening.

Another object of the present invention is to provide a closure in which the lifting tab and sealing tab at all times remain attached to the can lid, but can be shifted to a position remote from the pouring opening to permit safe drinking from the can.

A still further object of the present invention is to provide a closure which permits the can to be opened, i.e., the sealing tab to be sheared and shifted to a position remote from the opening, through the use of a relatively small amount of force so that the present can can be quickly and easily opened.

Yet another object of the present invention is to provide a closure including means for pivotally mounting the lift tab to the can top for cooperative interaction with the sealing tab without the use of rivets.

A preferred form of closure constructed in accordance with the principles of the present invention comprises a seal tab forming an integral part of the can lid, the seal tab being separated from the remainder of the lid by means of a score line or line of weakening. The closure also includes a lifting tab which overlies the sealing tab. The sealing tab includes two spaced and recessed grooves separated by a projection.

The lift tab includes a main portion with a finger opening which lies adjacent to the can top and a downwardly extending arm portion including two spaced arms which reside in the grooves of the sealing tab and a transverse pivot arm which interconnects the free ends of the two side arms. The pivot arm is constrained for pivotal movement between the bottom and rear wall of the two grooves, a rear wall of the projection and the bottom wall of a retaining projection which overlies the pivot arm. The lid also includes a transverse, upstanding rib or fulcrum located adjacent the end walls of the two grooves and adapted to be engaged by the lift tab as that member is pivoted.

To open the present container, the free end of the lift tab is raised and pivoted upwardly until it engages the fulcrum rib. During this initial movement of the lift tab, there is no corresponding movement of the seal tab.

Further pivotal movement of the lift tab, however, causes that member to pivot about the fulcrum rib so that the arms of the lift tab are forced against the adjacent portions of the seal tab. The seal tab is thereby caused to bulge and is severed along the score line to form the pouring opening in the lid of the can.

To complete the opening of the can, the lift tab is pivoted rearwardly until it lies closely adjacent to a portion of the top remote from the opening and the seal tab is pressed downwardly against the lift tab.

One advantage of the present closure construction is that the can can be opened with a minimum amount of force.

A further advantage of the present closure is that the sealing tab is forced outwardly away from the can opening so that the contents of the can are not contaminated.

A further advantage of the present closure construction is that it requires no rivets or sharp 180° bends to join the lift and seal tabs. Consequently, the problems of cracking and leakage caused by such rivets are eliminated.

Other objects and advantages of the present invention will be more reaidly apparent from a consideration of the following detailed description of the drawings illustrating a preferred embodiment of the invention.

DETAILED DESCRIPTION OF A PREFERRED EMBODIMENT

Figure 1:
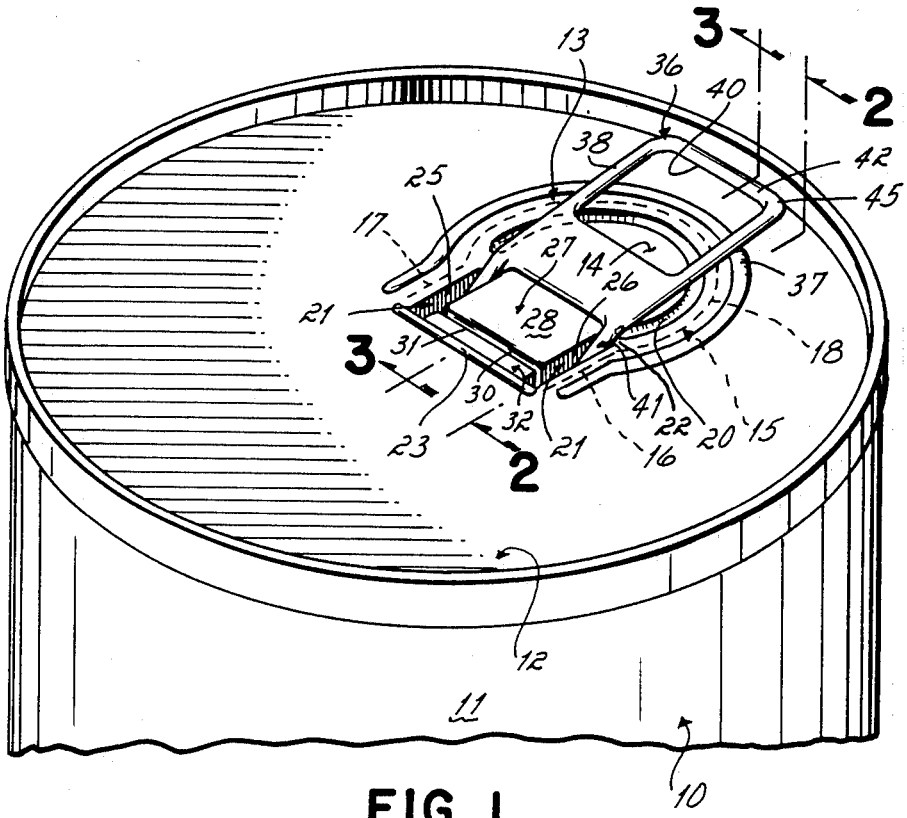
FIG. 1 is a perspective view of the top of a preferred form of beverage can embodying the present invention.

A preferred form of can embodying the closure of the present invention is illustrated in FIG. 1. As there shown, the can 10 is of generally cylindrical configuration having a cylindrical side wall 11, a circular bottom wall (not shown) and a circular top wall 12. Cans of this type are commonly fabricated from aluminum or light gage steel and are used for soft drinks, beer, and the like. It is to be understood that can 10 represents merely one possible can with which the present closure can be used and that the closure of the present invention is also susceptible to use with plastic cans.

It is further to be understood that the invention is not restricted to use with the particular can shown, but can be employed with any can in which it is desired to provide a closure capable of being opened by means of a suitable lift tab with the closure remaining attached to the can after the can has been opened. It is also to be understood that various features of the present closure can be utilized singly or in any combination in the construction of a lift tab-actuated nondetachable closure.

Figure 2:
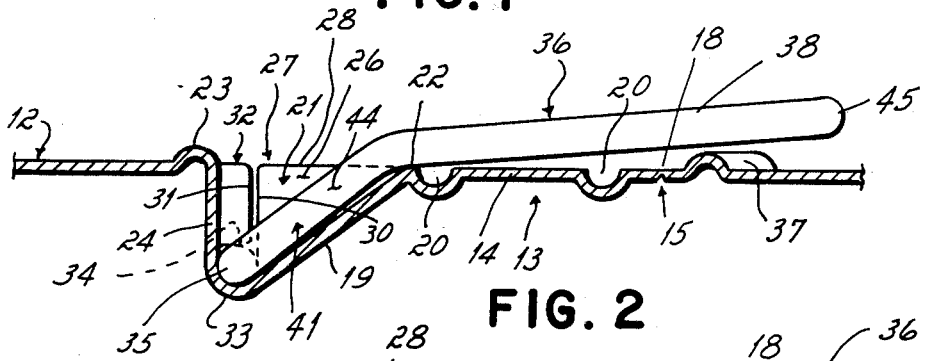
FIG. 2 is a cross-sectional view taken along line 2—2 of FIG. 1.

A closure 13 constructed in accordance with the principles of the present invention comprises a seal tab 14 formed integral with the can top and delineated from the remainder of the top by means of a score line, or line of weakening, 15. Line of weakening 15 is formed by scoring the undersurface of the lid so that the residual metal is relatively thin and can be readily severed. As shown in FIGS. 1 and 2, the score line 15 is of a generally keyhole or pear-shaped outline including two spaced parallel segments 16 and 17, the ends of which are joined by a curved section 18. A curved reinforcing rib 20 extends around the curved portion of the sealing tab 14, the rib being spaced inwardly a small distance from the line of weakening 15.

The sealing tab 14 further comprises two downwardly sloping recessed grooves 21. These grooves extend parallel to one another and include a sloping bottom wall 19 running from a point 22 in the vertical plane of the top and closely adjacent to the end of recessed rib 20 inwardly relative to the periphery of the can top 12 and downwardly relative to the plane of said top.

The can top 12 further comprises a raised transverse fulcrum rib 23 which is connected to vertical end walls 24 of the recessed grooves 21. Each of the recessed grooves includes a vertical side wall 25 and spaced parallel inner side walls 26. The inner side walls 26 are formed on a projection 27 having a top wall 28, which lies in the plane of the can top, and a vertical rear wall 30 which extends parallel to end walls 24 of recessed grooves 21 and to the adjacent wall 31 of a retaining projection 32 which extends forwardly from the can top between recessed grooves 21.

As shown in FIG. 2, the bottom wall 19 of grooves 21 is joined to vertical end wall 24 by a curved section 33. A bottom wall 34 of retaining projection 32 is spaced above curved sections 33 so that the transverse pivot arm 35 of lift tab 36 can be received in the lowermost portion of grooves 21 and can be retained in place for rotating movement between curved sections 33 and the bottom retaining wall 34.

In addition to the elements described above, top wall 12 further includes an elevated stiffening rib 37 which is disposed outwardly of line of weakening 15 and is spaced closely adjacent thereto. It is to be understood that all of the elements described above, except for raised tab 36 and its pivot arm 35, are formed as part of an integral stamped lid 12.

Figure 3:
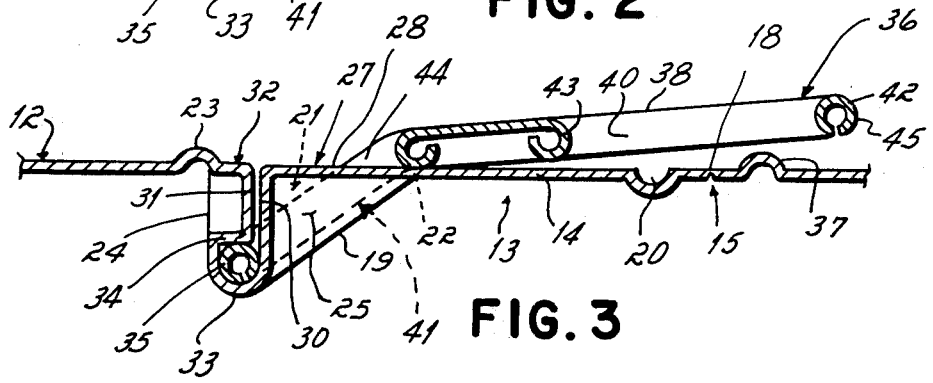
FIG. 3 is a cross-sectional view taken along line 3—3 of FIG. 1.

Lift tab 36 is formed as a separate member of aluminum or sheet steel. As shown in FIGS. 1–3, the lift tab 36 includes a generally flat main section 38 having a finger opening 40 formed therein and an arm portion 41 extending downwardly at an obtuse angle to main portion 38. In order to stiffen the lift tab, the periphery of the tab is rolled over to form a circular bead 42. A similar bead 43 is formed around the periphery of the finger opening 38.

The arm portion 41 of the lift tab comprises two spaced parallel side arms 44 which lie on opposite sides of projection 27 and within recessed grooves 21. The free ends of the arms 44 are joined by a transversely extending pivot arm 35 which lies against the curved section 33 at the bottom of each of the grooves 21. This arm is free to pivot, but is constrained against horizontal movement by its engagement of end walls 24 of grooves 21 and rear wall 30 of projection 27. The pivot arm is constrained against upward movement by bottom wall 34 of retaining projection 32. In the embodiment shown, arms 44 and pivot arm 35 are formed of a circular bead similar to bead 42.

One preferred form of fabricating a can in accordance with the present invention is to form lift tab 36 in a conventional manner. Lid 12 is also formed in a conventional manner, except for retaining projection 32 which is not formed until the lid and lifting tab are assembled.

In the next step, the pivot arm 35 of the lift tab 36 is inserted between the rear wall 30 of projection 27 and end walls 24 of the recessed slots 21. Side arms 44 of the lift tab are inserted in the slots 21 until they rest against sloping bottom walls 19. In this position, the main portion 38 of the lift tab lies closely adjacent to the top wall 12 of the can with the bottom surface of the lift tab being in engagement with rib 37. This provides a slight spacing between the free end 45 of the lift tab and the adjacent portion of wall 12 to facilitate grasping of the lift tab. After the lift tab has been properly positioned, projection 32 is formed so that the pivot arm 35 of the lift tab is clamped in position between walls 33 and 34. The lift tab is thereafter free to be pivoted upwardly and rearwardly, but cannot be shifted in any other direction.

Figure 4:
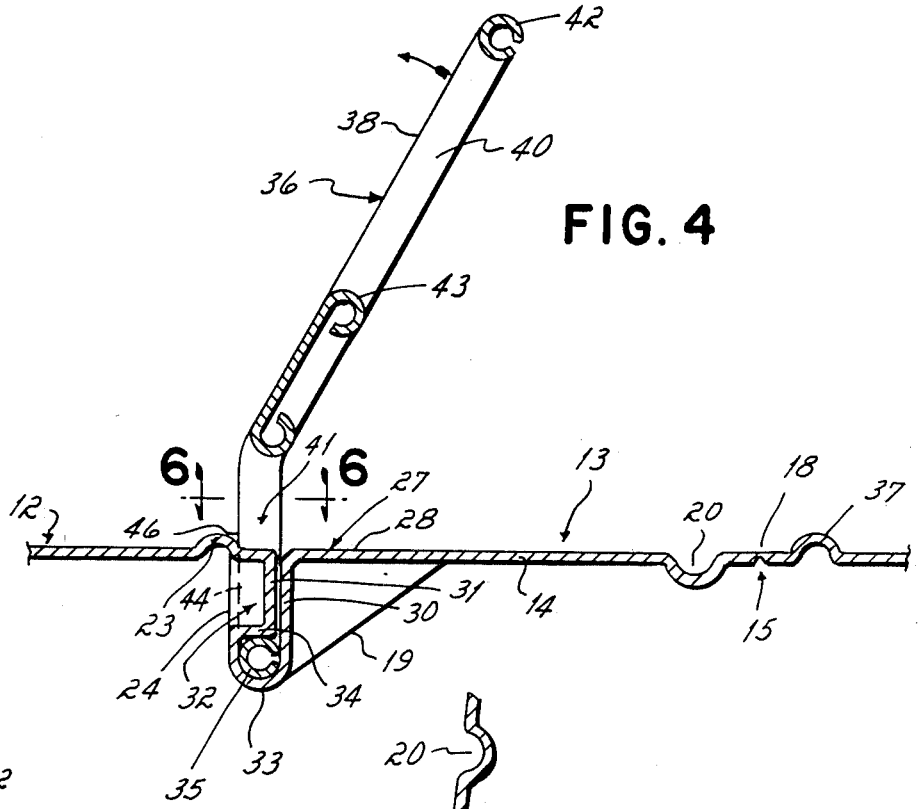
FIG. 4 is a cross-sectional view similar to FIG. 3 showing the lifting tab in a partially raised position.
Figure 5:
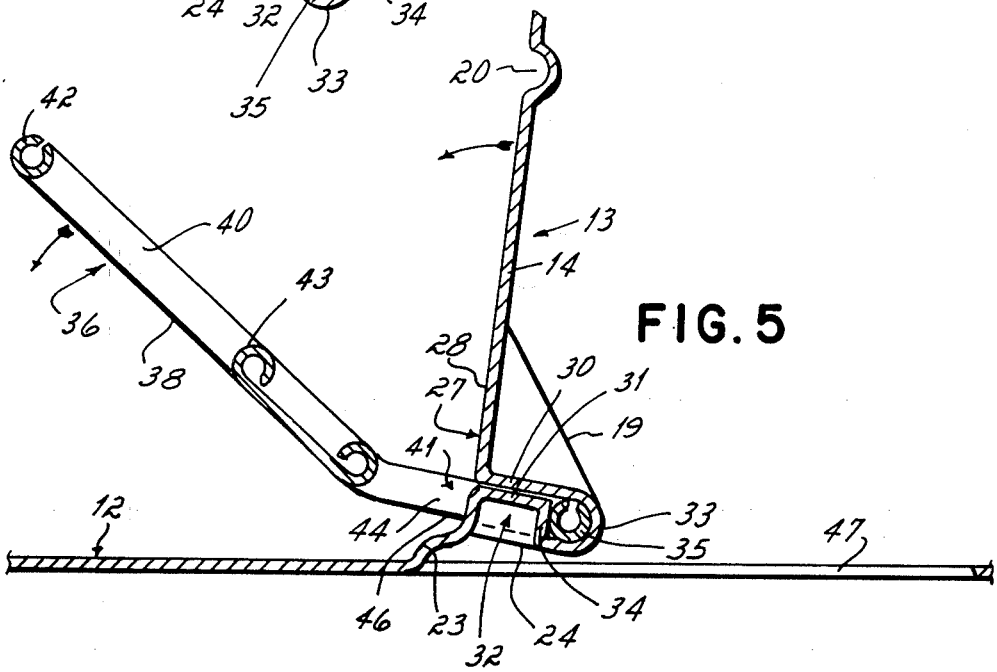
FIG. 5 is a cross-sectional view similar to FIG. 4 showing the lifting tab pivoted to a position remote from the opening formed in the top by the outward movement of the sealing tab.
Figure 6:
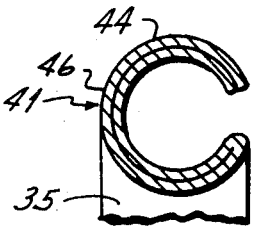
FIG. 6 is a cross-sectional view taken along line 6—6 of FIG. 4.

In order to open a can embodying the present closure, the user grasps the cylindrical side wall of the can 11 with one hand and with the other hand grasps the free end 45 of the lift tab. The lift tab is raised and pivoted rearwardly to the position shown in FIG. 4. As the lift tab is shifted, side arms 44 initially move freely within slots 21. When the arm portion of the lift tab reaches a generally vertical position, top surface 46 of the side arms 44 is brought into abutment with raised rib, or fulcrum, 23. These side arms are preferably rolled into a bead for stiffness. Further pivotal movement of the lift tab in the direction indicated by the arrows causes the side arms to pivot about fulcrum 23. This in turn causes the transverse pivot arm 35 to be shifted outwardly away from fulcrum 23 toward the periphery of the can. Arm 35 in turn presses against rear wall 30 of projection 26 and sloping walls 19 which are formed as parts of the sealing tab 14.

Pivot arm 35 thus applies a load to the sealing tab which bulges it upwardly and causes an initial shear at the weak point 22 of the lid between the ends of the slots 21 and depressed rib 20. The shearing which starts at this point thereafter occurs along the entire line of weakening 15 as the lift tab is pivoted rearwardly. The sealing tab thus leaves a key-shaped pouring opening in the lid, but remains attached to the lid. When the lift tab 36 is shifted to its fully open position, i.e., against the upper surface of the lid, the sealing tab has been rotated completely free from opening 47. The sealing tab can be pressed flat against the portion of the top wall remote from opening 47 so that the tab will not interfere with the user's drinking contents from opening 47 in the usual way.

From the above disclosure of the general principles of the present invention and the preceding detailed description of a preferred embodiment, those skilled in the art will readily comprehend the various modifications to which the present invention is susceptible. Thus, for example, it is contemplated that the present method of attachment of the lift tab to the lid which eliminates the use of rivets can be utilized in a construction in which the lift tab forces the sealing tab downwardly into the can. Therefore, I desire to be limited only by the scope of the following claims.

Having described my invention, I claim:

1. A closure for beverage containers, said closure comprising:

a top wall adapted to be secured to the container;

a sealing tab defined by a score line within said top wall;

a lifting tab lying within the periphery of said top wall and overlying at least a portion of said sealing tab, said lifting tab comprising a main portion and an arm portion angled downwardly from said main portion;

recessed means carried by said lid portion for restraining and supporting said arm portion for pivotal movement;

fulcrum means disposed on said top wall for engagement with an area of said lifting tab remote from the ends thereof;

a projection on said sealing tab disposed for engagement with the arm portion of said lifting tab when said tab is rotated about said fulcrum means, whereby when said lifting tab is pivoted about said fulcrum means, said arm portion engages said abutment, shearing said sealing tab along said line of weakening and forcing said tab outwardly away from the opening formed in said top wall.

2. The closure of claim 1 in which said fulcrum means comprises an upstanding transverse rib.

3. The closure of claim 1 in which the main portion of said lifting tab includes a finger opening.

4. The closure of claim 1 in which said sealing tab is key-shaped including two spaced parallel straight edges and a curved edge.

5. The closure of claim 4 in which said fulcrum means comprises an upstanding rib spaced from, and extending transversely of, the ends of said straight key edges.

6. The closure of claim 4 in which said lid further comprises an upstanding rib surrounding said sealing flap and closely spaced therefrom.

7. The closure of claim 4 in which said sealing flap further comprises a reinforcing rib disposed inside said score line and extending around a major portion of the periphery of said seal flap.

8. A closure for beverage containers, said closure comprising:

a top wall adapted to be secured to the container;

a seal tab defined by a score line within said top wall;

a lifting tab lying within the periphery of said top wall and overlying at least a portion of said sealing tab, said lifting tab comprising a main portion and an arm portion angled downwardly from said main portion;

said arm portion including a pair of parallel spaced side arms and a pivot arm interconnecting the free ends of said side arm;

fulcrum means disposed on said top wall for engagement with an intermediate portion of said lifting tab;

said sealing tab comprising two spaced parallel grooves receiving said side arms, said grooves terminating in a vertical wall;

a projection on said sealing tab disposed for engagement with the pivot arm of said lifting tab;

a second projection formed on said lid, said second projection having a bottom wall overlying said pivot arm, whereby said pivot arm is held in assembled relationship with said top wall and is restrained for pivotal movement relative thereto;

said lifting tab, when pivoted about said fulcrum means, being effective to apply a force to said sealing tab to shear said sealing tab along said line of weakening and urge said tab outwardly away from the opening formed in said top wall.

9. The closure of claim 8 in which said fulcrum means comprises an upstanding rib.

10. The closure of claim 8 in which said sealing tab is key-shaped including two spaced parallel edges and a curved edge.

11. The closure of claim 10 in which said grooves extend parallel to said straight edges.

12. The closure of claim 8 in which said main portion of the lifting tab includes a finger opening.

13. The closure of claim 8 in which each of said grooves includes a downwardly sloping bottom wall and a vertical end wall.

14. The closure of claim 8 in which each of said grooves further comprises a curved section joining said bottom wall and end wall and said pivot arm rests on said curved section.

15. The closure of claim 8 in which said lid further comprises an upstanding rib surrounding said sealing flap and closely spaced therefrom.

16. The closure of claim 8 in which said sealing flap further comprises a reinforcing rib extending inside said score line and extending around a major portion of said sealing flap.

17. The closure of claim 16 in which said reinforcing rib is closely spaced from one of said grooves to form a weak portion at which shearing is initiated.

18. In a closure for beverage containers, said closure comprising a top wall adapted to be secured to the container, a sealing tab defined by a scope line in said top wall, and a lifting tab within the periphery of said top wall and overlying at least a portion of said sealing tab, the lifting tab when pivoted being effective to sever said sealing tab along said line of weakening and to shift said sealing tab relative to the plane of said top wall, the improvement which comprises:

a pair of parallel spaced side arms formed on said lifting tab, said side arms extending downwardly;

a pivot arm interconnecting the free ends of said side arms;

the top wall having grooves for receiving said side arms, and a first projection disposed intermediate said arms for engagement with said pivot arm;

said lid having a wall spaced from said projection for engaging the opposite side of said pivot arm;

said lid further being provided with a second projection having a bottom wall overlying said pivot arm, whereby said pivot arm is held in assembled relationship with said top wall and is restrained for pivotal movement relative thereto.

19. The structure of claim 18 in which said wall is formed at the end of at least one of said grooves.

20. The structure of claim 19 in which each of said grooves includes a bottom wall sloping downwardly and said pivot arm engages said bottom wall.

21. The structure of claim 20 in which said first projection includes a vertical wall spaced from, and extending parallel to, the aforesaid wall at the end of said groove.

* * * * *